US006565735B1

(12) United States Patent
Fortunati et al.

(10) Patent No.: US 6,565,735 B1
(45) Date of Patent: May 20, 2003

(54) PROCESS FOR ELECTROLYTIC PICKLING USING NITRIC ACID-FREE SOLUTIONS

(75) Inventors: Sandro Fortunati, Terni (IT); Yoannis Demertzis, Milan (IT); Stefano Trasatti, Milan (IT); Paolo Giordani, Crema (IT); Augusto Musso, Rome (IT); Franco Mancia, Rome (IT)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 09/786,848

(22) PCT Filed: Sep. 2, 1999

(86) PCT No.: PCT/EP99/06451

§ 371 (c)(1),
(2), (4) Date: Jul. 13, 2001

(87) PCT Pub. No.: WO00/15880

PCT Pub. Date: Mar. 23, 2000

(30) Foreign Application Priority Data

Sep. 11, 1998 (IT) ..... M198A1998

(51) Int. Cl.[7] ..... C30B 9/14; B01D 17/06
(52) U.S. Cl. ..... 205/704; 205/741
(58) Field of Search ..... 205/710, 705, 205/714, 723, 117, 741, 137, 138, 704

(56) References Cited

U.S. PATENT DOCUMENTS

| | | | | |
|---|---|---|---|---|
| 4,814,054 A | * | 3/1989 | Roberts et al. | 204/207 |
| 5,332,446 A | | 7/1994 | Didier et al. | 134/3 |
| 5,382,335 A | * | 1/1995 | Jirenec et al. | 204/144.5 |
| 5,660,708 A | | 8/1997 | Tezuka et al. | 205/205 |
| 5,786,556 A | | 7/1998 | Gronlund et al. | 205/705 |
| 5,804,056 A | | 9/1998 | Pempera et al. | 205/661 |
| 5,840,173 A | | 11/1998 | Waldmann | 205/705 |
| 6,120,671 A | | 9/2000 | Karner et al. | 205/147 |
| 6,391,187 B1 | | 5/2002 | Eklund et al. | 205/710 |

FOREIGN PATENT DOCUMENTS

| | | | |
|---|---|---|---|
| DE | 39 37 438 C2 | | 8/1990 |
| DE | 196 24 436 | | 1/1998 |
| DE | 197 55 350 | | 6/1999 |
| EP | 0 541 448 | | 5/1993 |
| EP | 0 582 121 B1 | | 2/1994 |
| EP | 0 505 606 B1 | | 11/1995 |
| EP | 0 763 609 A1 | | 3/1997 |
| EP | WO 97/43463 A1 | * | 11/1997 |
| EP | 0 838 542 A1 | | 4/1998 |
| JP | 58 064 399 | | 4/1983 |
| JP | 62 222 100 | | 9/1987 |
| JP | 04 041 693 | | 12/1992 |
| JP | 10 219 500 | | 8/1998 |
| WO | WO9004047 | | 4/1990 |
| WO | WO 97/43463 | | 11/1997 |
| WO | WO 98/26111 | | 6/1998 |

* cited by examiner

*Primary Examiner*—Edna Wong
(74) *Attorney, Agent, or Firm*—Stephen D. Harper; Daniel S. Ortiz

(57) ABSTRACT

A process for electrolytic pickling of stainless steel of the ferritic, martensitic, austenitic and duplex series as well as superaustenitic and superferritic steels, nickel or Ni/Cr-based super alloys, and titanium and its alloys is provided. The process utilizes an electrolytic pickling solution containing $H_2SO_4$ in a concentration of from 20 to 140 g/l and $Fe^{3+}$ ions in a concentration of from 15 to 80 g/l, the $Fe^{2+}$ ions being present a quantity corresponding to a $Fe^{3+}/Fe^{2+}$ ratio of >1 and preferably >3.

22 Claims, 5 Drawing Sheets

PROCESS FOR ELECTROLYTIC PICKLING USING NITRIC ACID-FREE SOLUTIONS

This application is a United States national phase application filed under 35 U.S.C. §371 claiming priority from International Application PCT/EP99/06451, filed Sep. 2, 1999, and published under PCT Article 21(2) in English.

FIELD OF THE INVENTION

The present invention regards a process for pickling and surface finishing of cold-rolled products or plane or long draw pieces made of stainless steel of the austenitic, ferritic and martensitic types, duplex steels, superaustenitic and superferritic steels, special alloys of nickel or nickel-chromium.

The process, which has been devised in particular for continuous production, comprises a number of operating steps, at least one of which consists of a stage of electrolytic treatment, on processing lines in which the material to be pickled may or may not undergo a pre-treatment in a molten salt bath.

Specifically, the present invention replaces the electrolytic bath in nitric acid and is followed by a treatment of passivation and/or final pickling, according to the type of material undergoing treatment.

RELATED ART

For pickling of stainless steels that are cold-rolled and subjected to thermal treatment of annealing, numerous electrolytic pickling processes are known, among which the following are cited to provide examples:

The patent DE-A-19624436 describes a process for electrolytic pickling using only HCl as acid agent, together with ferric chloride, in a concentration of from 30 to 120 g/l. The steel strip to be pickled is made to pass between pairs of electrodes set on both faces of the strip, the electrodes of each pair having the same polarity. Arrangements of the electrodes are described in the sequence cathode-anode-cathode-cathode-anode-cathode, the elementary unit being thus represented by the ternary sequence cathode-anode-cathode. The current density is in the region of 3 to 4 A/dm$^2$. The treatment temperature is between 50° C. and 95° C.

The patent DE-C-3937438 describes a pickling process using a solution containing from 5 to 50 g/l of HF and up to 150 g/l of $Fe^{3+}$. Re-oxidation of $Fe^{2+}$ to $Fe^{3+}$ is obtained electrolytically by causing the material being pickled to function as anode in the pickling solution against cathodic counter-electrodes or using the pickling tank itself as a cathode. The anodic current density is between 0.1 and 1/A/dm$^2$.

EP-A-838542 describes a process in which the steel strip passes vertically between pairs of counter-electrodes. A neutral electrolyte is used consisting of sodium sulphate in a concentration of 100 to 350 g/l and with a current density on the strip of between 20 and 250 A/dm$^2$.

WO 98/26111 describes a process for the pickling of steels and titanium alloys with the use of $H_2SO_4$- and HF-based solutions containing $Fe^{3+}$ or $Ti^{4+}$ as oxidizing agents that form during the process by means of electrolytic oxidation of the corresponding reduced cations.

EP-A-763.609 describes electrolytic pickling of stainless steel using cells in series comprising alternately anodes and cathodes as counter-electrodes. The electrolytic solution is $H_2SO_4$-based.

JP 95-130582 uses an $H_2SO_4$-based electrolytic solution (20 to 400 g/l) containing nitrates and/or sulphates for pickling of stainless steel.

The known processes are substantially based on one of the following technologies or combinations thereof:

a) an initial treatment for conditioning the scale in molten salts (de-scaling), a subsequent treatment of electrolytic pickling carried out in nitric acid-based solutions, and finally, a chemical treatment in solutions of nitric acid or mixtures of nitric acid and hydrofluoric acid, according to the type of material to be treated;

b) an initial electrolytic treatment in sulphates, followed by a chemical treatment in nitric acid or in nitric acid/hydrofluoric acid mixtures;

c) an initial electrolytic treatment in solution of neutral sulphates, a second electrolytic treatment in solutions of nitric acid, and a final chemical treatment in solutions of nitric acid/hydrofluoric acid mixtures.

The diagram of FIG. 1 is a schematic representation of an electrolytic unit for the treatment of continuous stainless-steel strip, suitable for carrying out the process according to the present invention. The system comprises a sequence of various electrolytic units in which counter-electrodes having a cathodic function are alternated with counter-electrodes having an anodic function and are arranged along the path of the strip. As it passes through the various electrolytic units, the steel strip will assume by induction each time a polarity opposite to that of the counter-electrodes that it meets along its path.

In FIG. 1, the level of the solution is indicated by "L", the supporting rollers by R, and the immersion roller by R'.

As material for the anodic counter-electrodes arranged in the bath, cast iron or lead or some other material resistant to anodic attack will be used. For the cathodic counter-electrodes, stainless steel is generally used.

The current density on the stainless-steel strip in the anodic polarization stage may vary within a wide range; just to give some indication, it may range from 2 to 40 A/dm$^2$, and in particular from 3 to 30 A/dm$^2$. The current density on the stainless-steel strip in the cathodic polarization stage will vary according to the ratio between the cathodic and the anodic surfaces on the strip, which is generally between 1:2 and 1:6.

The cathodic current density will consequently be greater than the anodic current density (i.e., from 2 to 6 times higher).

Electrolytic treatment (in nitric or neutral sulphates) in the technologies described above constitutes the basic stage of the pickling process which enables a material with the desired surface characteristics to be obtained.

According to the technologies described previously, in the presence of electrolytic treatments with nitric acid solutions—technology a) or technology c)—an optimal finish of the product is obtained, but there emerge the well-known environmental problems linked to the emission toxic fumes of $No_x$ and to the presence of high concentrations of nitrate ions in the waste liquors. As regards pickling of the materials referred to herein carried out exclusively using chemical methods (as in the treatment of ferritic, martensitic and austenitic steels following on hot-rolling), these problems have already been tackled and solved by adopting nitric acid-free processes, such as those indicated in the patents EP 505606 and EP 582121. The replacement of nitric acid in electrolytic process applications typical of processes a) and c) has, instead, not yet been solved.

BRIEF DESCRIPTION OF THE INVENTION

According to the present invention, the electrolytic treatments described using nitric acid or other possible mineral acids are replaced by treatments using sulphuric acid-based solutions and ferric ions, and a subsequent final treatment of passivation and/or pickling is carried out or otherwise, according to the type of material being treated.

The use of solutions containing sulphuric acid and ferric ions as electrolytic bath enables the following results to be obtained:

1. Elimination of nitric acid, and hence solution of the environmental problems connected thereto;
2. Better characteristics of surface finish compared to those obtainable using treatments in electrolytic nitric acid solutions;
3. Rate of pickling equal to or higher than electrolytic treatments using nitric acid solutions.

DETAILED DESCRIPTION OF THE INVENTION

According to the present invention, an electrolytic process of pickling is achieved for the materials already described above which is carried out in the absence of nitric acid, with a solution containing sulphuric acid and ferric ions ($Fe^{3+}$), and which is capable of replacing completely, in terms of pickling capacity, passivating capacity and final qualitative appearance, the electrolytic processes that adopt nitric acid.

The electrolytic solution used contains sulphuric acid ($H_2SO_4$) in concentrations of from 20 to 140 g/l (preferably from 40 to 100 g/l), and ferric ions ($Fe^{3+}$) in concentrations of from 15 to 80 g/l, preferably from 20 to 50 g/l.

The quantity of the sulfuric acid is to be understood as the free acid, which results e.g. from an acid-base titration or from a conductometric analysis of a dilute solution according to a calibration curve, and has to be maintained during the process by successive additions of $H_2SO_4$ while the acid of the bath is used up by the formation of metal sulfates (ferric and ferrous, of bivalent Ni, of trivalent Cr, and of other metals).

The electrolytic process is carried out according to the operating phases and using a plant according to the known art, as described in the section "Related Art:".

As far as the operating conditions are concerned, a characteristic aspect is noted in particular in the fact that the product to be pickled, which is of a continuous type (e.g., a strip), is made to function successively as cathode and anode alternately (with a minimum of two alternations), according to the polarity of the counter-electrodes determined by the electrical voltage applied. In the final phase, the product is made to function preferably as an anode so as to obtain an appropriate passivation of the treated surface.

In its passage through the pickling tank, the product undergoes anodic treatment for a total time ranging from 5 to 15 sec.

Figure 2:
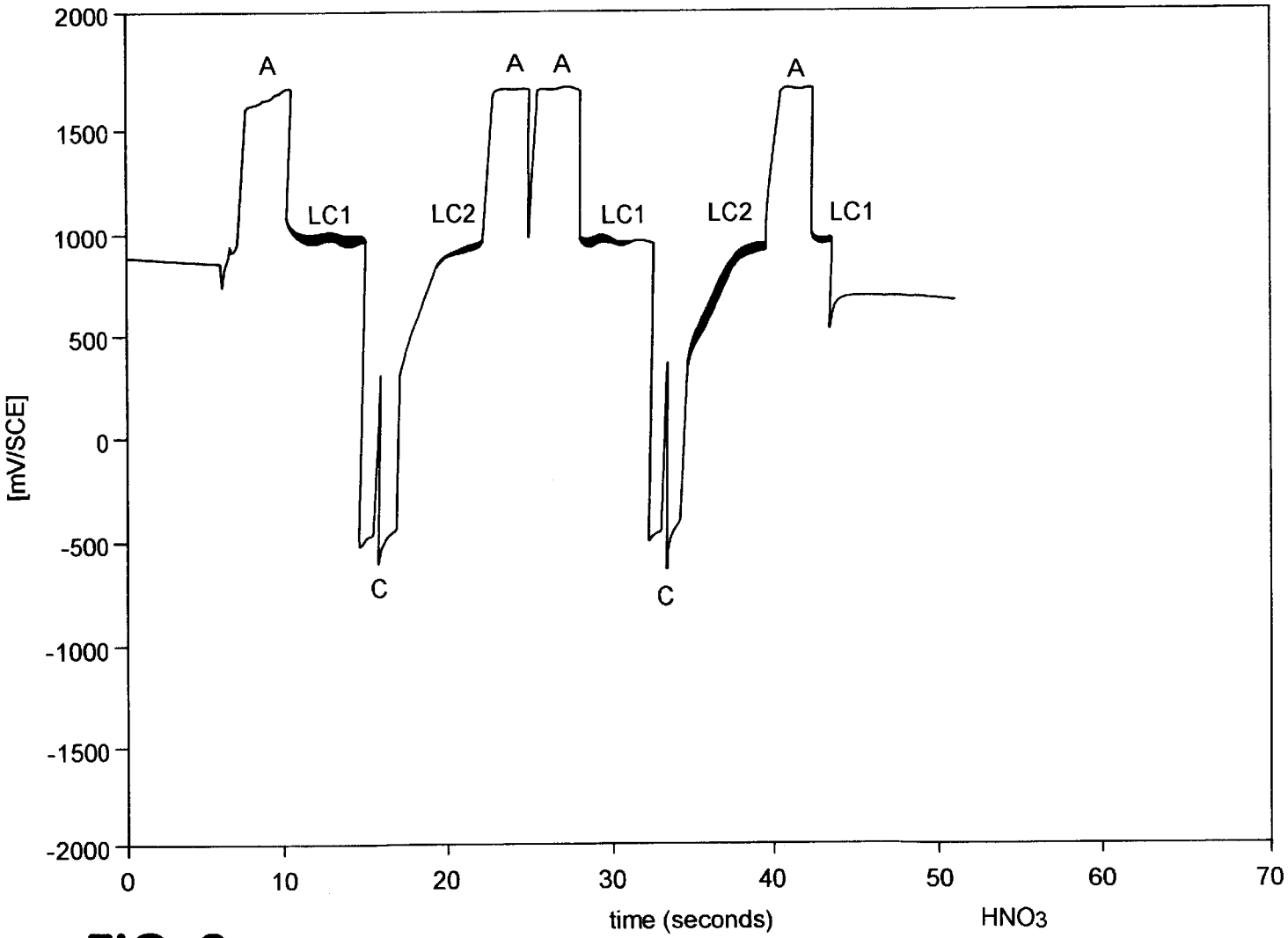
FIG. 2 is a plot of the potential of a metal during an electrolytic process in 10% by weight nitric acid solution.
Figure 5:
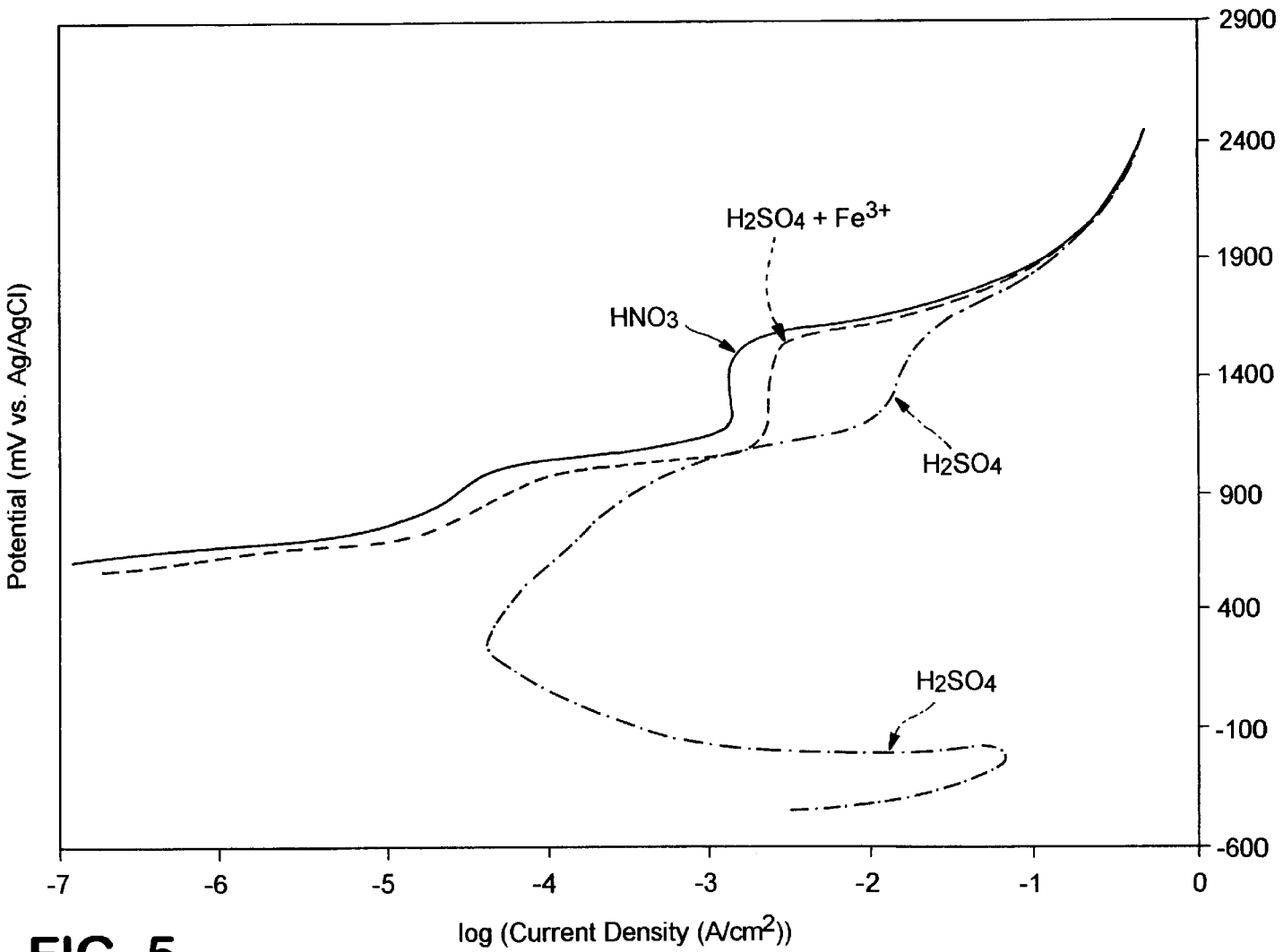
FIG. 5 is a plot of the potential vs. log (current density A/CM2) for metal in various solutions.

In the case of electrolytic pickling in solutions containing nitric acid, according to the known art, the attack during anodic polarization takes place in the transpassive region, at a potential higher than the development of oxygen (≈1200 mV in reference to the standard hydrogen electrode—see FIG. 2, Potentials A, as compared to the potentiodynamic curve of FIG. 5—and the surface of attack proves very homogeneous.

Outside the electric field, the surface of the steel always remains passive (see FIG. 2, Potentials LC1 and LC2, or "free corrosion" potentials).

Figure 3:
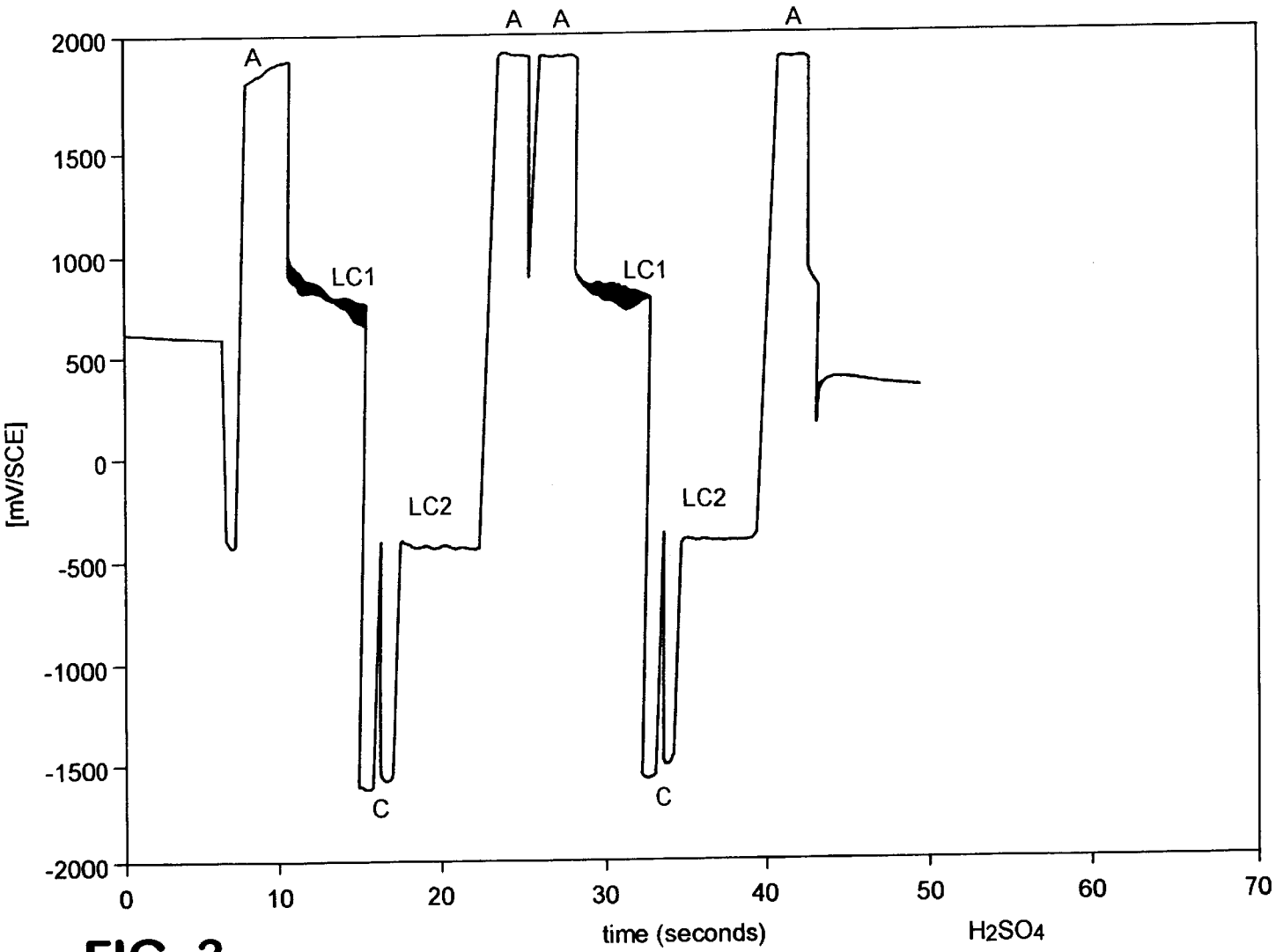
FIG. 3 is a plot of the potential of a metal during an electrolytic process in a 10% by weight sulphuric acid solution.
Figure 4:
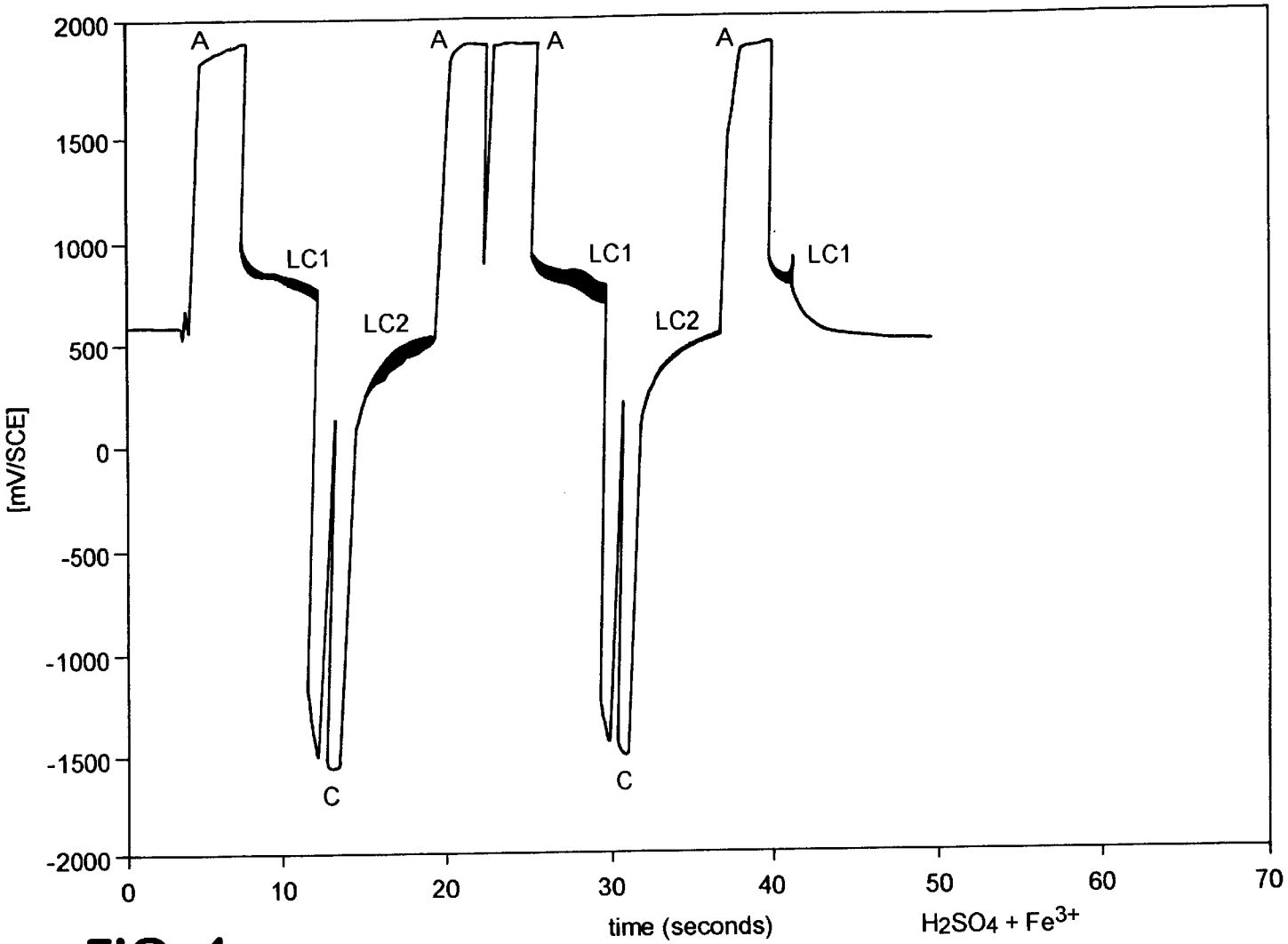
FIG. 4 is a plot of the potential of a metal during an electrolytic process of an embodiment of the invention in a 10% by weight sulphuric acid solution containing 3% by weight $Fe^{3+}$.

In FIGS. 2, 3 and 4, the letter A designates the potentials under the effect of anodic polarization, and C designates the potential under the effect of cathodic polarization, whereas LC1 and LC2 represent the potentials outside the electric field after anodic and cathodic polarization, respectively.

The process represented in FIG. 2 was recorded in a 10 wt % nitric acid solution; the process represented in FIG. 3 was recorded in a 10 wt % sulphuric acid solution; and the process represented in FIG. 4 was recorded in a 10 wt % sulphuric acid solution, plus 3 wt % $Fe^{3+}$.

The replacement of nitric acid with sulphuric acid alone does not enable the same standards of surface quality (lustre, passivatability) to be achieved. In fact, under anodic polarization in sulphuric acid solutions, the potential remains for a long time in the region of marked transpassive dissolution (see FIG. 3, Potentials A), as compared to the respective potentiodynamic curve of FIG. 5. This determines dissolution rates that are generally higher.

Furthermore, the sulphuric acid outside the electric field (i.e., outside the area facing the electrodes) proves aggressive: the potentials of free corrosion after cathodic polarization LC2 (see FIG. 3) are found, in fact, in the anodic dissolution region, as emerges from a comparison between the values of LC2 and the potentiodynamic curve of sulphuric acid (FIG. 5). However, in these conditions the attack proves inhomogeneous and leads to roughness and opacity of the surface.

On the contrary, nitric acid is passivating (the potentials LC1 and LC2 of FIG. 2 are found in the passive regions, if compared to the potentiodynamic curve for nitric acid shown in FIG. 5). As a result, a treatment using sulphuric acid alone determines excessive overall values of loss in weight, and consequently a final surface that is rough and has an opaque appearance. In addition, possible sulphate deposits may be found (this latter phenomenon is particularly evident when stainless steels of the ferritic type are treated).

The combined presence of sulphuric acid and ferric ions as oxidants, according to the present invention, determines a condition of passivity of the surface of the strip that is outside the electric field (see potentials LC1 and LC2 in FIG. 4 as compared to the corresponding curve in FIG. 3), whereas anodic attack takes place in a transpassive region as in the case of nitric acid (see FIGS. 2, 4 and 5). Ultimately, pickling in solutions of sulphuric acid/ferric ions leads to chemico-physical and electrochemical conditions comparable to electrolytic pickling in nitric acid, with final results that are at least equivalent.

The use of solutions according to the present invention enables pickling kinetics to be obtained that are comparable with or superior to those achievable using nitric acid, for the following reasons:

a) During anodic attack, the kinetics of dissolution in sulphuric acid and trivalent iron is higher than that in nitric acid (FIG. 5);

b) During the cathodic phase, the development of hydrogen according to the reaction $$2H^{+}+2e^{-}\rightarrow H_2$$

is greater in sulphuric acid plus trivalent iron than in nitric acid on account of the depolarization due to the reduction of the nitrates.

The development of hydrogen contributes to detaching the scale by mechanical action, and hence also to preparing the surfaces for a more even anodic attack. During the pickling process in $H_2SO_4/Fe^{3+}$ solutions, there is an increase in the concentration of $Fe^{2+}$. This increase in the concentration of $Fe^{2+}$ must be controlled by means of an at least partial re-oxidation of $Fe^{2+}$ to $Fe^{3+}$ so as to maintain the concentration of $Fe^{3+}$ between 15 and 70 g/l (preferably between 15 and 50 g/l) and maintain the $Fe^{3+}/Fe^{2+}$ ratio at values higher than 1, preferably >3, as well as maintaining a concentration of $Fe^{2+}$ preferably not higher than 10 g/l. The $Fe^{2+}\rightarrow Fe^{3+}$ oxidation may come about chemically using hydrogen peroxide (preferably) or using peracids or their salts. Alternatively the oxidation may occur in a special electrolytic cell, such as is claimed in patent WO 97/43463. Finally, the oxidation process may take place by using air or oxygen in catalytic systems, as claimed in patent DE 19755350.8.

In the case of chemical oxidation using hydrogen peroxide, the feed may be carried out continuously or discontinuously either directly into the tank or, preferably, in a recirculation pipe outside the tank so as to maximize the reaction yield. The yield of the oxidation reaction can be improved using stabilizers that are specific for hydrogen peroxide, such as phenacetin, secondary or tertiary aliphatic alcohols, glycols, glycol ethers, ethoxylated or ethopropoxylated non-ionic surfactants blocked on the terminal hydrogen.

The electrolytic solution can operate both in static conditions and under agitation, using, for instance, a circulating pump or by blowing in air. Mixing may afford the advantage of removing from the interface the gas that forms on the underside of the steel strip.

The electrolytic solution according to the present invention is kept at a temperature of between 15° C. and 60° C., and preferably between 15° C. and 40° C. In particular, maintaining the solution at a temperature of between 15° C. and 40° C. by means of a heat exchanger makes it possible to obtain a final surface which is particularly shiny with a reflectivity superior to that obtainable using electrolytic processes in nitric acid. For the application of the invention, both the electrolytic pickling plants used and the current densities applied do not differ from those usually adopted for nitric acid solutions (see current state of the art). As far as the current densities are concerned, however, the resultant increase in the dissolution rate, applying the present invention, makes it possible to use even lower values: good results are achieved also with current densities on the strip in the anodic polarization regions of 3 $A/dm^2$.

In the context of a global pickling process, the electrolytic process according to the present invention may be advantageously combined with pretreatments that form part of the known art (e.g., treatment in molten salts, as the one known commercially as KOLENE. at 450–500° C.).

As regards the treatments that follow electrolytic pickling, according to the present invention, the following are described and claimed:

solution of $H_2SO_4$ (from 10 to 90 g/l) and stabilized free $H_2O_2$ (from 3 to 20 g/l), for stainless steels of the ferritic type;

solution of $H_2SO_4$ (from 50 to 200 g/l), HF (from 10 to 40 g/l) and $Fe^{3+}$ and $Fe^{2+}$ ions with an $Fe^{3+}/Fe^{2+}$ ratio$\geqq$1.5, for austenitic steels and superalloys.

The concentrations of $H_2SO_4$ and of HF indicated above relate to the free acids and not to the total of the anions $SO_4^{2-}$ and $F^-$. In addition, the total free acid (as the sum of $H_2SO_4$ and HF) should be in the range from 1:5 to 6.0 equivalents/L.

In order to increase the pickling kinetics in the $H_2SO_4/Fe^{3+}$ electrolytic bath of the present invention, it is useful to add chloride ions, especially in the case of treatment of ferritic stainless steels, in a concentration of from 1 to 20 g/l, whereas, in the case of austenitic or super stainless steels or superalloys, it is preferable to add fluoride ions in a concentration of from 1 to 20 g/l.

As an overall description of the pickling possibilities according to the process of the present invention, the following operating cycles may be adopted, depending upon the type of steel to be treated:

A) Cold-rolled Ferritic Steels

A.1 "De-scaling" treatment in molten-salt bath (e.g., commercial product "Kolene") at 450° C.–500° C.;

A.2 Electrolytic pickling according to the invention;

A.3 Washing with water;

A.4 Final passivation according to the invention in a solution of $H_2SO_4$ (10–90 g/l) containing stabilized $H_2O_2$ (3–20 g/l) at room temperature;

A.5 Washing with water.

B) Cold-rolled Austenitic Steels

B.1 De-scaling treatment as in A.1;

B.2 Electrolytic pickling according to the invention;

B.3 Washing with water;

B.4 Chemical pickling for surface finishing and passivation according to the invention with a solution containing:

$H_2SO_4$ (50–200 g/l), HF (10–40 g/l), plus $Fe^{3+}$ and $Fe^{2+}$ ions in an $Fe^{3+}/Fe^{2+}$ ratio>1.5, at a temperature between 40 and 65° C.;

B.5 Washing with water.

C) Cold-rolled Ferritic Steels

C.1 De-scaling and pickling in an electrolytic bath according to the invention, possibly containing chloride (HCl) ions in a concentration of from 0 to 20 g/l;

C.2 Washing with water;

C.3 Chemical pickling for surface finishing and passivation as in A.4;

C.4 Washing with water.

D) Cold-rolled Austenitic Steels

D.1 De-scaling and pickling in electrolytic bath according to the invention, possibly containing fluoride (HF) ions in a concentration of from 1 to 20 g/l;

D.2 Washing with water;

D.3 Chemical pickling for surface finishing and passivation as described in B.4 (temperature 60° C.);

D.4 Washing with water.

EXAMPLE

To provide an example, an electrolytic pickling process according to the present invention will now be described for the treatment of a continuous strip of cold-rolled stainless steel sheet of the ferritic type (series 400) having a width of 1200 mm, previously treated with molten salts according to step A.1.

Figure 1:
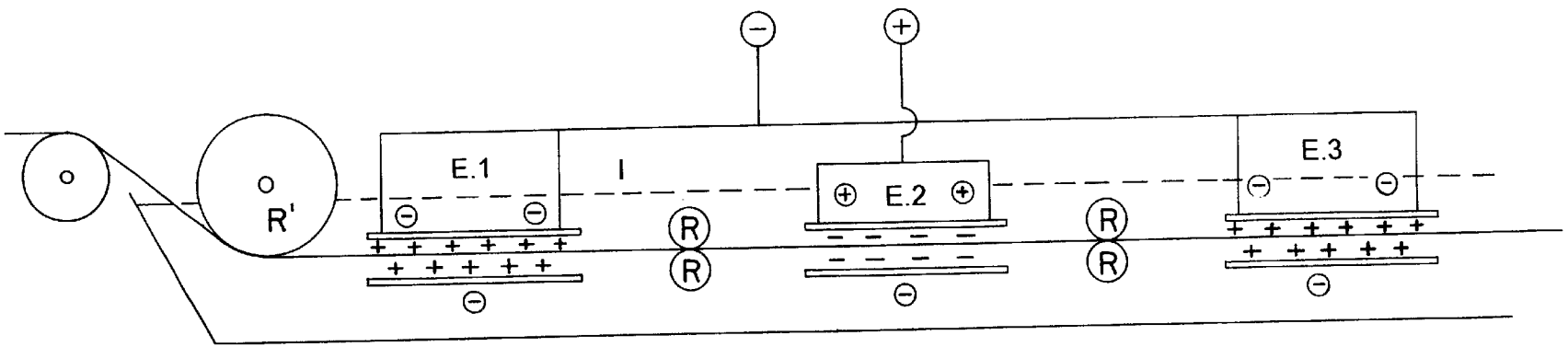
FIG. 1 is a schematic representation of an embodiment of the process of the invention.

The electrolytic apparatus adopted is represented schematically in FIG. 1 as regards the essential structural elements and comprises a rectangular tank in which the useful path length of the strip in contact with the solution is 17.5 m.

FIG. 1 illustrates only the first basic electrolytic unit (module) supplied with electric current having an intensity of 3700 A. This is followed by a second, similar unit supplied with a 2100-A current.

In the diagram of FIG. 1, the first electrolytic region E.1 is represented, where the cathodic counter-electrode consists of a rectangular plate set beneath the strip, having the side parallel to the path of the strip 1200 mm long and the transverse side (width) 1760 mm long.

An identical plate, also having the function of cathodic counter-electrode, is set above the strip.

In the second electrolytic region E.2 the counter-electrode functions as anode following on the application of a voltage higher than that of the counter-electrode E.1: the steel strip, in the part facing the anodic counter-electrode E.2, will thus assume the function of cathode.

The anodic counter-electrode E.2 consists of two rectangular plates, one set above and the other set beneath the strip, each having the side transverse to the direction of the path of the strip measuring 1760 mm, and the side that is parallel measuring 600 mm.

In the third electrolytic region E.3, the counter-electrode functions as that of region E.1 and presents the same geometrical characteristics.

The rate of passage of the strip is approx. 33 m/min, the contact time with the solution is in the region of 32 sec, whilst the total anodic treatment time of the strip is approximately 9 sec.

The bath is equipped with anodic counter-electrodes made of silicon cast iron and stainless steel and cathodic counter-electrodes made of stainless steel, and is provided with a heat exchanger to dispel the heat developed during the process. The electrolytic solution of the path (approximately 30,000 litres) is kept throughout the progress of the strip at a temperature of 18° C. to 26° C. by means of cooling with the heat exchanger, the sulphuric acid content is kept at between 40 and 50 g/l, and that of $Fe^{3+}$ at 30 to 32 g/l, whilst the content of $Fe^{2+}$ is kept controlled at a concentration not higher than 10 g/l by oxidation to $Fe^{3+}$ with $H_2O_2$, which is periodically added to the bath.

At the end of the test, the content of $Fe^{2+}$ in the bath was 8.8 g/l and hence the $Fe^{3+}/Fe^{2+}$ ratio was in the region of 3.5 and the total Fe content was approximately 41 g/l.

From the test carried out it may be concluded that the system works with good results by regulating the intensity of current passing in the module at a value corresponding to a current density on the strip in the area in which it is anodically polarized of approximately 6.4 $A/dm^2$.

The current density on the strip in the area in which the latter is cathodically polarized is twice this figure, i.e., approximately 12.8 $A/dm^2$ (since the total surface of the cathodically polarized strip is approximately one half that of the anodically polarized strip).

In the second electrolytic unit supplied with 2100 A, the current density on the strip will be approximately 3.64 $A/dm^2$ in the anodic area and 7.28 $A/dm^2$ in the cathodic area.

The total amount of Fe present in the solution during the process is the resultant of the iron transferred to the bath by the steel strip being processed, of the iron removed from the bath as a result of the entrainment of the liquid by the strip coming out of the bath, and of the iron eliminated by partial discharge of solution made during the process and aimed at preventing an excessive content of total Fe.

The duration of the test, which was carried out continuously, was 8 days. The material treated amounted to 1,486.4 tonnes, corresponding to a pickled surface of 394,886 $m^2$.

The consumption of $H_2O_2$ (calculated at 100%) was 1,464 kg, and the consumption of sulphuric acid with titre of 65% was 7,785 kg.

Upon exit from the electrolytic tank, the strip passes continuously into a tank of the same dimensions for the passivation treatment carried out according to the conditions indicated in step A.4. The duration of treatment was approximately 30 sec. The redox potential of the bath remained higher than +500 mV (as compared to a standard calomel electrode—SCE). the consumption of $H_2O_2$ (calculated at 100%) was 112 kg and that of $H_2SO_4$ with titre of 65% was 900 kg.

What is claimed is:

1. A process for electrolytic pickling of a material selected from the group consisting of stainless steels of the ferritic, martensitic, austenitic and duplex series, superaustenitic and superferritic steels, Ni and Ni/Cr-based super alloys, titanium and titanium alloys, the process comprising: passing the material between at least a first pair of electrodes and a second pair of electrodes in an electrolytic apparatus, in contact with an aqueous electrolyte solution, wherein a first electrode of a pair faces a first side of the material and a second electrode of a pair faces a second side of the material and wherein the first and the second electrodes of the pair have the same polarity, passing an electric current between the electrodes and the material, as the material passes between the first pair of electrodes and the second pair of electrodes, wherein the polarity of the first pair of electrodes and the second pair of electrodes in a direction in which the material is passing is opposite and a ratio of a current density in the electrolytic apparatus of a cathodic polarized area of the material to a current density of an anodic polarized area of the material is from 2:1 to 6:1, and the aqueous electrolyte solution comprises:

(a) from 20 to 140 g/l $H_2SO_4$;

(b) from 15 to 80 g/l of $Fe^{+3}$ ions; and (c) a quantity of $Fe^{+2}$ ions such that an $Fe^{+3}/Fe^{+2}$ ion ratio is >1.

2. The process according to claim 1, in which $H_2SO_4$ is present in the aqueous electrolyte solution in a quantity from 40 to 100 g/l.

3. The process according to claim 1, in which $Fe^{+3}$ ions are present in the aqueous electrolyte solution in a quantity from 20 to 50 g/l.

4. The process according to claim 1, in which $Fe^{+2}$ ions are present in the aqueous electrolyte solution in a quantity wherein the $Fe^{+3}/Fe^{+2}$ ion ratio is >3.

5. The process according to claim 4, in which the $Fe^{+3}/Fe^{+2}$ ion ratio is kept at a desired value by a means selected from the group consisting of electrolytic oxidation, catalytic oxidation with the use of oxygen or gases containing oxygen, and addition of an oxidant selected from the group consisting of hydrogen peroxide, peracids, persalts and combinations thereof.

6. The process according to claim 4 in which the value of the $Fe^{+3}/Fe^{+2}$ ion ratio is controlled by addition of stabilized $H_2O_2$.

7. The process according to claim 6, in which the addition of $H_2O_2$ is made by a system that provides for immediate mixing of the $H_2O_2$ with the aqueous electrolyte solution.

8. The process according to claim 7, wherein the system is selected from the group consisting of a) feed-in through recirculation pipes by means of pumps; b) feed-in using air or liquid venturi systems; c) feed-in with rails provided with spray nozzles and combinations thereof.

9. The process according to claim 1, wherein a temperature of the aqueous electrolyte solution is between 15° C. and 60° C.

10. The process according to claim 1, wherein a temperature of the aqueous electrolyte solution is between 15° C. and 40° C.

11. The process according to claim 1, in which the material while being subject to the process has a total surface having an anodic function from 2 to 6 times greater than a surface having a cathodic function.

12. The process according to claim 1, wherein the material is made to function alternately as an anode and cathode, by determining the curve of the potential over time, where the potential values are referred to a standard calomel reference electrode (SCE).

13. The process according to claim 1, in which chloride ions in a quantity of 1 to 20 g/l are present in the aqueous electrolyte solution.

14. The process according to claim 1, in which fluoride ions in a quantity of 1 to 20 g/l, are present in the aqueous electrolyte solution.

15. The process according to claim 1, comprising an additional treatment selected from the group consisting of:

(a) immersion in a second aqueous solution comprising $H_2SO_4$ and ≧3 g/l free $H_2O_2$ where the material is a stainless steel of the ferritic or martensitic series; and (b) immersion in a third aqueous solution comprising $H_2SO_4$, HF, $Fe^{+3}$ ions and $Fe^{+2}$ ions where the material is a stainless steel of the austenitic series, a duplex steel, a superaustenitic or superferritic steel, or a Ni or Ni/Cr-based superalloy.

16. The process according to claim 15, wherein the second aqueous solution comprises 10–90 g/l $H_2SO_4$ and 3–20 g/l free $H_2O_2$.

17. The process according to claim 15, wherein the third aqueous solution comprises a concentration of 50–200 g/l $H_2SO_4$, 10–40 g/l HF and $Fe^{+3}$ ions and $Fe^{+2}$ ions in an $Fe^{+3}/Fe^{+2}$ ion ratio>1.5, said concentrations referring to free acids, and a total free acidity being in the range from 1.5 to 6.0 equivalents/l.

18. The process according to claim 1, in which the current density on the material, when the material functions as an anode, is between 2 and 40 $A/dm^2$.

19. The process according to claim 1, in which the current density on the material, when the material functions as an anode, is between 3 and 30 $A/dm^2$.

20. The process according to claim 1, in which as the material passes between a last pair of electrodes, the material has a function of an anode.

21. The process according to claim 1, in which the material undergoes anodic treatment for a total time of between 5 and 15 sec.

22. The process according to claim 1, in which the material passes between at least three pairs of electrodes set according to a cathode/anode/cathode sequence.

* * * * *

UNITED STATES PATENT AND TRADEMARK OFFICE

CERTIFICATE OF CORRECTION

PATENT NO. : 6,565,735 B1
DATED : May 20, 2003
INVENTOR(S) : Fortunati et al.

It is certified that error appears in the above-identified patent and that said Letters Patent is hereby corrected as shown below:

Title page,
Item [30], Foreign Application Priority Data, delete "M198A1998", and insert therefore -- M198A001998 --.

Signed and Sealed this

Second Day of November, 2004

JON W. DUDAS
*Director of the United States Patent and Trademark Office*